US005230179A

United States Patent [19]

Richmond et al.

[11] Patent Number: 5,230,179

[45] Date of Patent: * Jul. 27, 1993

[54] APPARATUS AND METHOD FOR OPENING AND CLOSING A GATE

[75] Inventors: Moscow K. Richmond, Los Angeles; Thomas R. Richmond, Santa Ana; Patrick S. Kochie, Simi Valley, all of Calif.

[73] Assignee: Doorking, Inc., Inglewood, Calif.

[ * ] Notice: The portion of the term of this patent subsequent to Apr. 17, 2007 has been disclaimed.

[21] Appl. No.: 922,619

[22] Filed: Jul. 30, 1992

Related U.S. Application Data

[63] Continuation of Ser. No. 712,528, Jun. 10, 1991, Pat. No. 5,136,809, which is a continuation of Ser. No. 459,526, Jun. 2, 1990, Pat. No. 5,076,012, which is a continuation-in-part of Ser. No. 185,444, Apr. 25, 1988, Pat. No. 4,916,680.

[51] Int. Cl.[5] ..... E05F 15/14

[52] U.S. Cl. ..... 49/28

[58] Field of Search ..... 49/26, 28, 138, 139, 49/147, 349, 358; 187/103, 104; 318/282, 271; 292/144, 201

[56] References Cited

U.S. PATENT DOCUMENTS

| | | | |
|---|---|---|---|
| 2,998,245 | 8/1961 | Adams | 49/138 X |
| 3,284,950 | 11/1966 | Gute | 49/28 |
| 3,775,906 | 12/1973 | Dougherty | 49/358 |
| 3,891,909 | 6/1975 | Newson | 318/282 |
| 4,234,833 | 11/1980 | Barrett | 318/282 |
| 4,271,384 | 6/1981 | Beling et al. | 318/318 X |
| 4,403,449 | 9/1983 | Richmond | 49/139 X |
| 4,429,264 | 1/1984 | Richmond | 318/466 |
| 4,472,910 | 9/1984 | Iha | 49/139 |
| 4,614,902 | 9/1986 | Jessup | 318/282 |
| 4,625,291 | 11/1986 | Hormann | 49/26 X |
| 4,916,860 | 4/1990 | Richmond et al. | 49/139 X |
| 5,076,012 | 12/1991 | Richmond et al. | 49/28 |
| 5,136,809 | 8/1992 | Richmond et al. | 49/28 |

FOREIGN PATENT DOCUMENTS

WO86/03249 6/1986 PCT Int'l Appl. .

*Primary Examiner*—James R. Brittain

*Attorney, Agent, or Firm*—Robert J. Schaap

[57] ABSTRACT

A gate opening and closing apparatus for moving a gate between a gate closed position which covers an access opening and a gate opened position. The apparatus comprises an electric motor for driving the gate between the open position and the closed position. A connecting arrangement connects the electric motor to the gate in order to enable powered movement of the gate between the gate opened and gate closed positions. A control unit in the form of a microprocessor control unit is operatively connected to the electric motor for control of the same and hence control of the movement of the gate. The gate normally remains unlocked at the closed position and is only locked when a force is applied to the gate tending to move same to the open position. In one embodiment, a positive locking mechanism, such as a solenoid lock may be provided and which is automatically locked when an opening force is applied to the gate. In another embodiment, the gate is not positively locked and the electric motor applies a closing force to the gate to overcome any effort of an opening movement. The gate opening and closing mechanism is uniquely constructed in that there is no gear box which would otherwise preclude a manual opening of the gate in the event of emergency.

20 Claims, 2 Drawing Sheets

APPARATUS AND METHOD FOR OPENING AND CLOSING A GATE

RELATED APPLICATIONS

This application is a continuation of U.S. patent application Ser. No. 712,528 dated Jun. 10, 1991 (now U.S. Pat. No. 5,136,809, dated Aug. 11, 1992) and which was a continuation of U.S. patent application Ser. No. 459,526, filed Jun. 2, 1990 (now U.S. Pat. No. 5,076,012, dated Dec. 31, 1991) and which was, in turn, a continuation-in-part of U.S. patent application Ser. No. 185,444 filed Apr. 25, 1988 (now U.S. Pat. No. 4,916,680, dated Apr. 17, 1990).

BACKGROUND OF THE INVENTION

1. Field of the Invention

This invention relates in general to certain new and useful improvements in an apparatus and method for controlling the opening and closing movement of gates, and more particularly, to an apparatus and method for automatically controlling the movement of gates on a highly efficient basis and which enables a gate to remain unlocked at the closed position until an opening movement force is applied to the gate.

2. Brief Description of the Prior Art

Over the years, a variety of types and styles of gates have been developed to provide security for such areas as parking structures and entrances and exits to residential and industrial properties. These gates may take the form of sliding gates which move in or on a track, or swinging gates which are rotatably hinged to a fixed structure. Where large passageways are involved, gates may be provided in pairs which operate from opposite sides of the openings.

Many control systems have been developed to provide automatic control for the opening and closing of gates. These control systems include an electric motor operatively connected to the gate to control its movement. Typically, the motor is controlled by a switch in the vicinity of the gate which can only be operated by authorized personnel. For example, the switch may be in the form of a key switch which can only be operated by use of a conventional key or by a card key.

Various prior art control systems also employ means for mechanically sensing when the gate is in its fully opened or fully closed position. These sensing means are typically in the form of limit switches which are used to deenergize the motor when the gate has reached its end position of travel. The limit switches must be individually adjusted for each gate installation to ensure proper alignment with the opened and closed positions of the gate. In addition, because of the mechanical nature of the limit switches, they tend to wear and change in their adjustment, resulting in improper gate operation.

In addition to detecting the opened and closed positions of the gate, safety considerations require means for detecting if the gate has encountered an obstruction in its travel. For example, such obstructions might be caused by a vehicle or pedestrian in the path of the gate while it is being operated. When an obstruction is detected, gate motion must be stopped to avoid damage to either the gate or the obstruction or injury to people.

In most of the prior art gate opening and closing mechanisms, a positive locking mechanism was provided to physically and automatically lock the gate when it reached the closed position. In this way, only authorized access to a controlled area was achieved. Many of these prior art positive locking mechanisms relied upon the use of a solenoid operated lock which included a locking pin on the gate capable of being inserted into an opening on a fixed structure at the gate closed position. However, in each case, the gate was automatically and positively locked when it reached the closed position.

The locking of the gate at the closed position, while effective to provide a measure of security, poses many problems to the occupants of the controlled area as well as to public officials. If for some reason, there is a malfunction of the gate operating mechanism, it automatically locks at the closed position and the occupants on the inside of the controlled area would not have egress through the access opening covered by the gate. Thus, some means to physically unlock the gate has to be provided. In addition, in the event of a power failure which could arise, as a result of disruption from an electrical utility supplier or as a result of a fire, it is necessary for public officials to have access to the controlled or secured area. Thus, some fire departments and other health control officials require a special unlocking mechanism located at the exterior of the gate and which is confined in a locked box or similar secured area to which they have special access. Many fire department or other health or other public officials require a special key for access to these locked boxes or secured containers.

In addition to the above, each of the prior art locking mechanisms also uses a complex gear structure for purposes of driving the gate between the opened and closed positions. While these gear boxes are effective, they are noisy and consume a substantial amount of the power generated by the electric motor. Moreover, it is virtually impossible to push a gate against the action of the gear box in the event of a power failure.

There have also been gate opening and closing apparatus which utilize sensors, such as optical sensors, for measuring the extent of movement of the gate between the opened and closed positions and thereafter controlling the gate during movements for the measured distance. In this way, the gate opening and closing apparatus will effectively measure the distance of the first movement of the gate and thereafter move the gate for that same distance during each subsequent opening and closing movement. One such opening and closing apparatus is more fully illustrated and described in U.S. Pat. No. 4,429,264, dated Jan. 31, 1984 by Moscow K. Richmond, for "System and Method For The Automatic Control Of Electrically Operated Gates".

There are many substantial drawbacks to the use of optical sensors for purposes of distance measuring. There is usually a substantial problem of dirt collection on the optical sensor which impairs the optical measuring system and which also requires frequent maintenance. More commonly, as a result of the operating equipment, grease and oil, which are regularly applied to the equipment for maintenance purposes, also tend to collect on the optical sensor thereby impairing the operation of the optical sensor.

U.S. Pat. No. 4,159,599, dated Jul. 3, 1979 by Moscow K. Richmond for "Gate Opening and Closing Assembly" discloses a gate which is slidable between opened and closed positions and which uses a solenoid operated locking mechanism. U.S. Pat. No. 4,313,281, dated Feb. 2, 1982 by Moscow K. Richmond for "Gate Opening and Closing Apparatus and Method" also discloses a positive locking mechanism for use in locking a gate when it reaches a gate closed position. U.S. Pat. No. 4,330,958 by Moscow K. Richmond, dated May 25, 1982 for "Gate Opening and Closing Assembly With Automatic Locking Means" also discloses a gate opening and closing assembly with an automatic locking means for locking the gate when it reaches a closed position.

OBJECTS OF THE INVENTION

It is, therefore, one of the primary objects of the present invention to provide a gate opening and closing apparatus in which a gate remains unlocked at a closed position until an opening movement force is applied to the gate which automatically causes a locking action.

It is another object of the present invention to provide a gate opening and closing apparatus of the type stated which may be constructed with a positive operating lock which is automatically locked when a force is applied to the gate which would otherwise cause an opening movement of the gate.

It is a further object of the present invention to provide a gate opening and closing apparatus of the type stated in which no locking mechanism need be employed and in which the electric motor will cause a locking action of the gate against any unauthorized opening movement force.

It is an additional object of the present invention to provide a gate opening and closing apparatus of the type stated in which a magnetic sensor is employed for detecting the extent of movement of a gate between a gate opened position and a gate closed position and which thereby obviates many of the problems inherent with optical sensing mechanisms.

It is another salient object of the present invention to provide a gate opening and closing apparatus of the type stated which does not include a large gear box for transferring driving power from a motive means to the gate and which thereby permits opening of the gate by manual force in the event of a power failure.

It is also an object of the present invention to provide a gate opening and closing apparatus of the type stated which is quiet in operation and also highly reliable in operation and which can be constructed at a relatively low cost.

It is still another object of the present invention to provide a gate opening and closing apparatus of the type stated which provides for the automatic control of the opening and closing action of a gate and which also enables a gate to remain unlocked at the closed position until a force is imposed on the gate which tends to open the gate.

With the above and other objects in view, our invention resides in the novel features of form, construction, arrangement and combination of parts presently described and pointed out in the claims.

BRIEF SUMMARY OF THE INVENTION

The present invention relates to a gate opening and closing apparatus which has several unique and distinctive improvements over previously existing prior art gate opening and closing apparatus and methods of operation therefore in that the instant gate opening and closing apparatus is relatively trouble free and highly reliable in operation.

The gate opening and closing apparatus generally is capable of moving a gate between a gate opened position and a gate closed position where it covers an access opening. The apparatus comprises a motive means which may preferably be in the form of an electric motor for driving the gate between the gate opened and the gate closed positions. A connecting means is provided for connecting the motive means to the gate to cause a powered movement of the gate between the gate opened and gate closed positions. The connecting means may adopt the form of, for example, pulleys or sprockets, or the like mounted on the motive means and on the gate. A drive mechanism, such as a clutch structure, as hereinafter described in more detail, is interposed between the electric motor or other motive means and the gate.

A control means as for example, a microprocessor operated control means, is associated with the apparatus and initially measures the extent of movement of the gate between the gate opened and gate closed positions. A memory means is associated with the control means for recording the measure of movement of the gate between these gate opened and gate closed positions and which enables movement of the motive means under control of the control means on subsequent occasions. In this way, the gate is moved on subsequent occasions only in response to signals from the memory means to cause the gate to move only the distance measured in the initial movement of the gate.

A rotating member is associated with motive means and the control means and which is rotated in response to operation of the motive means when the gate is moved. A magnetic means, such as an assembly of one or more magnetic elements, and a magnetic sensor are provided and forms part of the control means for initially measuring the amount of movement of the rotatable member and hence, provides for initially measuring the amount of movement of the gate between the gate opened and closed positions. One part of this magnetic means, such as either the magnetic elements or the sensor forming part of the assembly thereof, is mounted on the rotatable member and the other is fixed and located in magnetically coupled relationship with respect thereto.

Another one of the unique aspects of the gate opening and closing apparatus and method of the present invention is the fact that there is no gear box or other complex gear structure interposed between the gate and the motive means therefor. In essentially all prior art gate opening and closing apparatus, the motive means, such as the electric motor, is connected to the gate through a complex gear box, which enables a powered movement of the gate. However, in the event of a power failure, it is virtually impossible to push the closed gate to an opened position against the action of the gear box.

The present invention obviates the problem of the gear box by providing a drive shaft which is journaled for rotation in a housing. A shaft drive pulley is mounted on the drive shaft and is coupled to the electric motor. A gate drive pulley is mounted for rotation with the drive shaft and is coupled to the gate for causing movement of the gate between the gate opened and closed positions. A clutch mechanism is interposed between the shaft drive pulley and the gate drive pulley and with no gear mechanism therebetween. This permits the movement of the gate to the opened position by manual operation and hence, a manual rotation of the drive shaft in the event of a power failure to the electric motor.

In one of the more preferred embodiments, the shaft drive pulley is coupled to the electric motor through a drive belt and the gate drive pulley is coupled to another pulley on the gate through another drive belt.

The clutch permits a positive driving action of the drive shaft through the shaft drive pulley when electric power is applied to the motor. This clutch also permits a slipping action between the clutch and the shaft drive pulley when electric power is not applied to the motor In another one of the unique aspects of the present invention, the control means causes the gate to move to the closed position and which remains at the closed position in an unlocked condition. Hence, the gate is essentially unlocked at the closed position and is only locked when there is a need for locking the same as hereafter described.

In the event that an unauthorized force is applied to the gate which tends to move the gate away from the closed position, an electrical gate locking signal is generated by a spike which is, in turn, generated in the field winding of the electric motor. This electrical spike signal is sensed by the control means and the control means will initiate a locking action in response to the application of a force which tends to move the gate away from the gate closed position. The term "locking action" is used in a broad sense to include any type of action which tends to hold the gate at the gate closed position against the opening force applied thereto, and does not necessarily imply the use of a positive lock therefor.

In one embodiment of the present invention, this locking action is created by the control means causing the motive means, such as the electric drive motor, to rotate in a direction where it moves the gate to the closed position. Thus, the electric motor will oppose any force which tends to push the gate to the open position.

In another embodiment of the invention, there is provided a solenoid operated locking mechanism. In this embodiment, the control means energizes the solenoid to cause a positive locking action by forcing a pin of the solenoid operated locking mechanism into a hole in a fixed structure In either event, the gate remains at the opened position in an unlocked condition until there is a need to actually lock the same.

In still another embodiment of the present invention, the magnetic means will operate in conjunction with the control means in order to generate a signal representative of an unauthorized opening movement. When there is a force tending to move the gate to the opened position, rotation of the magnetic means with respect to the magnetic sensor will provide a signal of that opening movement to the control means. If the control means has not generated a signal to cause the opening movement, then there will be an automatic recognition that the opening movement is an unauthorized one. In this case, the control means may then generate a signal to cause an automatic locking action, as for example, a signal to the solenoid to initiate the positive locking action.

This feature of the invention, which permits the gate to remain in the unlocked condition at the closed position, is highly advantageous in that it overcomes many of the problems previously encountered in the prior art gate operating mechanisms. In the event that there is a malfunction in the gate operating mechanism, the gate can be pushed to the opened position since it is not positively locked and since there is no complex gear structure interposed between the drive motor and the gate. Moreover, in the event of a power failure, the gate can also be pushed to the opened position. This eliminates the need which was previously encountered for providing access to health and safety officials.

The control means and the motive means operate in conjunction with one another to detect an obstruction in the path of the movement of the gate. The control means will automatically cause the motive means to reverse the direction of the movement of the gate upon the detection of any such obstruction. The obstruction is detected by sensing a current rise in the motive means as a result of the gate contacting the obstruction. This current rise is detected by the control means to cause the motive means to operate in the opposite direction and move the gate back toward the open position.

The gate opening and closing apparatus of the present invention is also constructed so that the control means causes the gate to move at a high rate of speed from the gate opened position to the gate closed position and automatically causes the motive mean to slow the rate of the movement from the high rate of speed to a slow rate of speed shortly in advance of the closed position.

The term gate is used in a generic sense to include doors and like structures and essentially constitutes any movable frame work or structure which controls entrance or exit through an access opening to provide a passageway.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understand that such detailed description is not to be taken in a limiting sense.

BRIEF DESCRIPTION OF THE DRAWINGS

Figure 1:
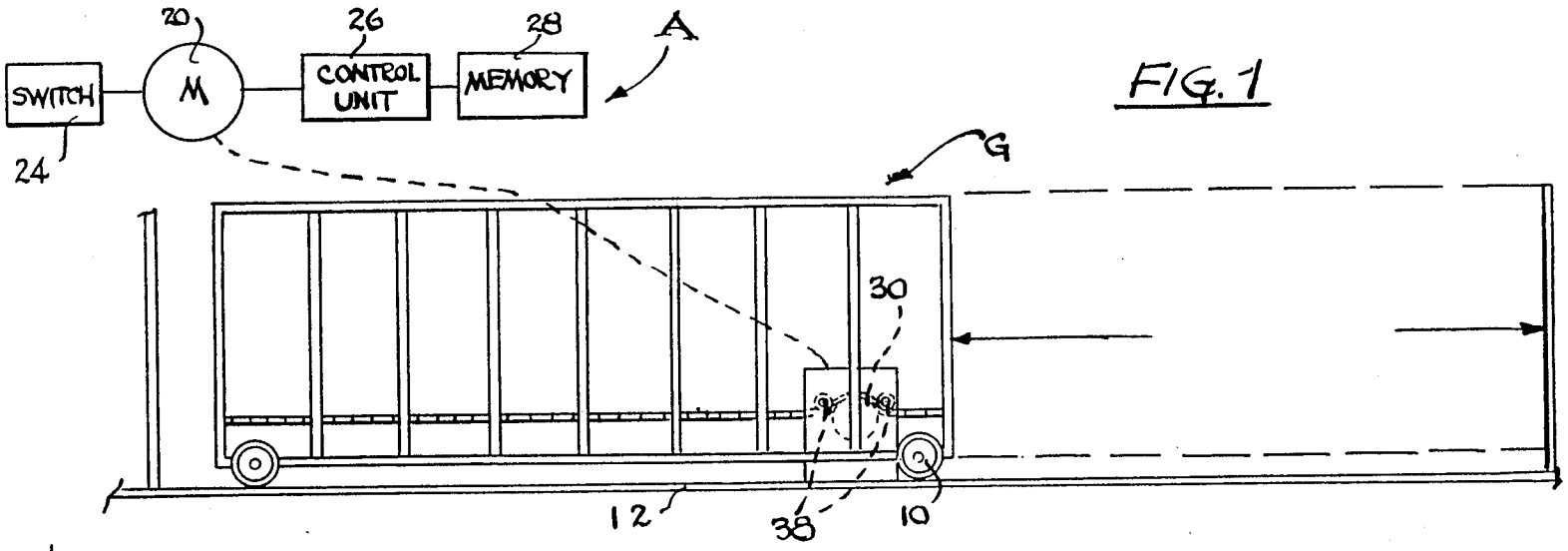
Figure 3:
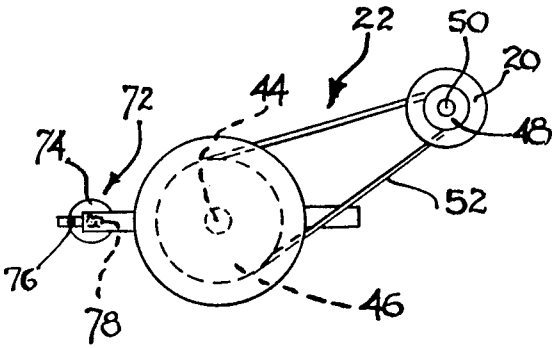
Figure 2:
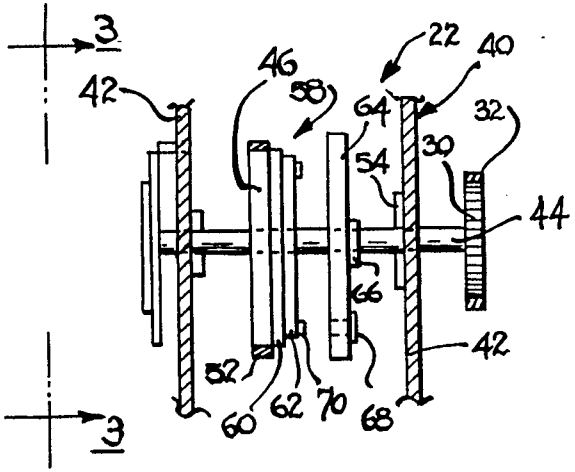
Figure 4:
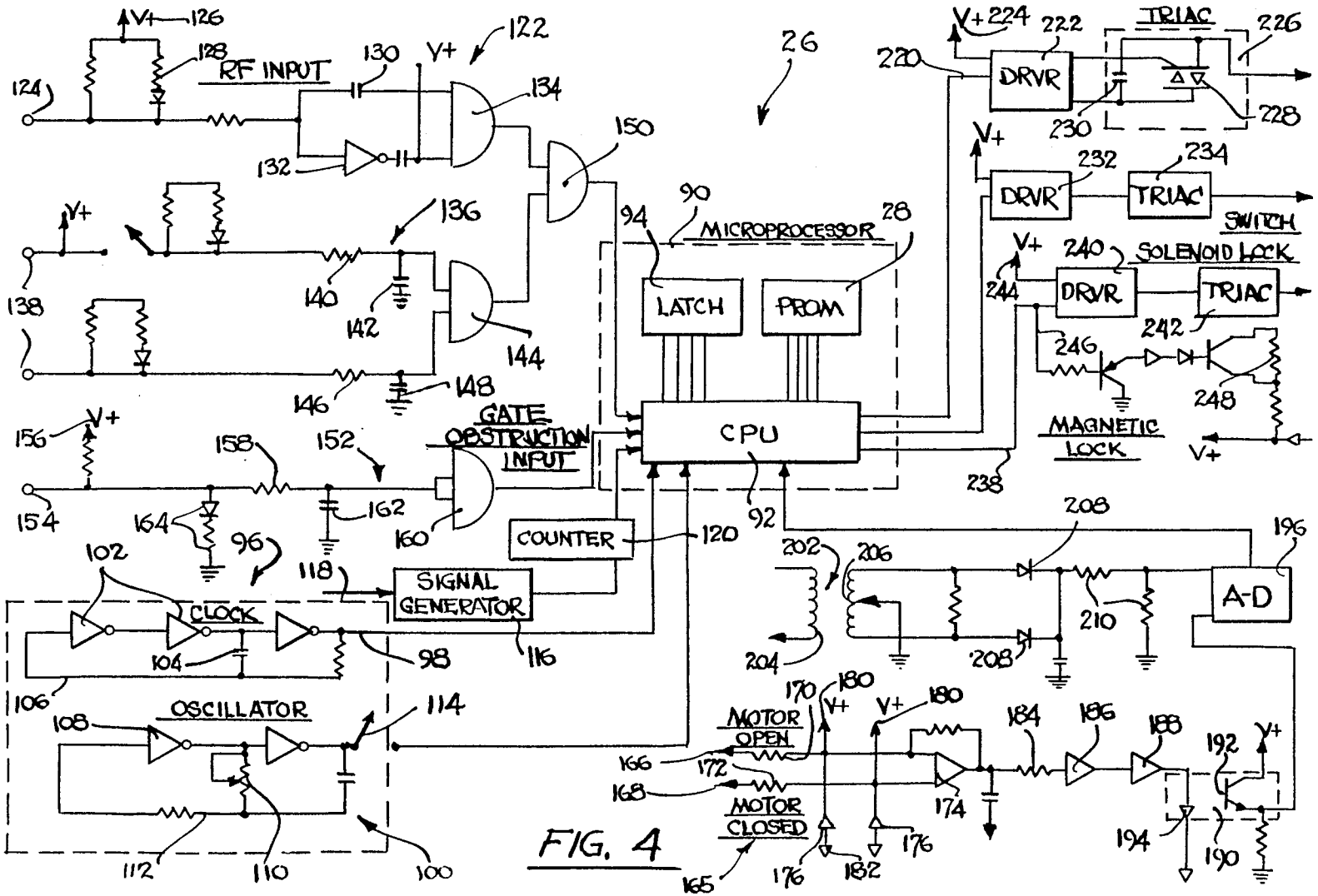

Having thus described the invention in general terms, reference will now be made to the accompanying drawings (two sheets) in which:

FIG. 1 a schematic side elevational view showing one form of gate opening and closing apparatus constructed in accordance with the present invention and showing an operative connection to a gate;

FIG. 2 is a side elevational view, partially broken away and in section, of a gate opening and closing apparatus constructed in accordance with and embodying the present invention;

FIG. 3 is an end elevational view, taken substantially along line 3—3 of FIG. 2, and showing a portion of the gate opening and closing apparatus of the present invention; and FIG. 4 is a schematic circuit view showing the control circuit forming part of the gate opening and closing apparatus of the present invention.

DETAILED DESCRIPTION OF A PREFERRED EMBODIMENT

Referring now in more detail and by reference characters to the drawings which illustrate a preferred embodiment of the present invention, "A" designates a Gate Opening and Closing Apparatus shown with operative connections to a laterally shiftable gate G, often referred to as a "sliding gate". In this case, the gate G is shiftable from a closed position across an access opening to and the opened position and from the opened position to the closed position by means of the apparatus. The gate G may be part of any conventional construction and, as such, does not form part of the present invention per-se. The gate is conventionally provided with rollers 10 and which are movable along a trackway 12, the later of which is fixed to the ground or other supporting surface.

In essence, gates of this type are used with security apartment buildings an similar commercial establishments and dwelling structures. The access opening permits passage of either people or vehicles and the gate can be shifted from the closed to the opened position for such access. Generally, many commercially available prior art gate opening and closing apparatus operate with a radio frequency receiver-transmitter system, such that the party desiring to open the gate will actuate the transmitter to generate a signal which, in turn, causes the receiver to energize a motor for shifting the gate. In essence, transmitter-receiver systems of this type operate as a switch. In this respect, the apparatus of the present invention can be used with a key operated system or with the conventional radio frequency operated transmitter-receiver system.

FIG. 1 also illustrates the major components forming part of the gate opening and closing apparatus A of the present invention and which comprises an electric drive motor 20 which is operatively connected to a drive unit 22, the later of which is hereinafter described in more detail. A switch 24 is schematically shown as being connected to the motor 20. The switch may adopt the form of a key operated switch or radio frequency operated switch or other type of switch mechanism, as aforesaid. The apparatus also comprises a control unit 26 which is more fully illustrated in FIG. 4, along with a memory 28. This memory 28 may actually form part of the control unit 26 as hereinafter described in more detail.

The drive unit 22 causes operation of a gate drive pulley or sprocket 30 which, in turn, causes movement of a drive chain or so-called "drive belt" or cable 32. The drive belt 32 is trained about the drive sprocket 30 and is held in coupled engagement with the sprocket 30 by tension in the drive belt 32. One end of the belt 32 is mounted to the gate G and the other end of the belt 32 is mounted to a fixed structure. The drive belt 32 is also trained over a pair of idler rollers or sprockets 38 to provide tension to the belt. In this case, the term "drive belt" is used in a broad sense to include any form of connecting belt or drive belt or chain. In like manner, the term "pulley" is used in a broad sense to refer to any type of rotatable member such as a drive sprocket, or a wheel or the like.

It can be observed, in accordance with the construction illustrated in FIG. 1, that as the drive unit 22 is operated, it will cause rotation of the gate drive pulley 30 in either the clockwise or counter-clockwise direction. This will cause movement of the gate to the opened position, if operated in the clockwise direction and will cause movement of the gate to the closed position, if operated in the counter-clockwise direction.

The drive unit 22 is more fully illustrated in FIGS. 2 and 3, and comprises an outer drive unit housing 40. Only portions of a pair of the end walls 42 of the housing 40 are illustrated. Extending between the end walls 42 is a drive shaft 44 and by reference to FIG. 2, it can be observed that the gate drive pulley 30 is mounted on this drive shaft 44. Also mounted on the drive shaft 44 is a shaft drive sprocket 46 and which is connected to a pulley 48 on a motor shaft 50 by means of a drive belt 52. The drive shaft is also journaled in a bearing 54.

A clutch mechanism 58 is comprised of a clutch plate 60 mounted on a flat surface of the shaft drive pulley 46 and a corresponding and mating clutch plate 62 which may be engageable with the plate 60. When the two clutch plates 60 and 62 are disposed in mating engagement, there will be a complete powered rotation of the gate drive pulley 30. However, the clutch plates are constructed so that in the reverse direction, the clutch plate 60 can slip with respect to the plate 62 when there is no power applied to the drive shaft 44 from the electric motor 20.

Operatively mounted on the shaft 44, but which is not rotatable therewith, is a support plate 64 and which is retained on the shaft in a non-rotatable disposition by means of a bearing arrangement 66. A magnetic detector or so-called "sensor" 68 is mounted on the plate 64 and is located to magnetically detect the passage of magnetic elements 70 mounted on a face of the clutch plate 62, in the manner as illustrated in FIG. 2 of the drawings. In this way, it is possible to count each rotation of the shaft drive pulley 46 and hence the drive shaft 44.

The magnetic sensor 68 is electrically coupled to the control unit 26, in a manner as hereinafter described in more detail. In this way, the extent of movement and hence the distance of travel of the gate between the gate closed and the gate opened position, or otherwise, between the gate opened position and the gate closed position can be measured. Each rotation of the drive shaft 44 will represent a fixed increment of distance of movement of the gate. Therefore, by measuring the total number of rotations of the magnetic elements 70, it is possible to precisely measure the extent of movement of the gate G from the fully opened position to the fully closed position, or otherwise from the fully closed position to the fully opened position. A signal representative of this measurement is stored in the control unit and it is used on subsequent occasions to cause energization of the motive means, such as the drive motor 20, for movement of the gate G for the measured distance between the opened and closed positions.

The use of the magnetic sensor assembly, as described herein, offers many unique advantages over the optical sensor mechanism which has been employed in prior art gate opening and closing apparatus. As heretofore described, this magnetic sensor mechanism is not sensitive to the dirt and grease and other foreign matter accumulation which typically arises in gate opening and closing apparatus. Hence, the present apparatus is reliable and essentially trouble free in operation. Moreover, it does not require the maintenance previously encountered with prior gate opening and closing apparatus.

In addition to the foregoing, it can be observed that there is no complex gear structure located between the shaft drive pulley 46 and the gate drive pulley 30 and more particularly between the drive pulley 30 and the gate G. In this way, if there is a power failure, a user can push the gate G from the closed position to the opened position against only the action of the motor 20. There is no complex gear structure which would preclude normal manual movement of the gate from the closed position to the opened position. Thus, the aforesaid construction has eliminated many of the problems previously described and which were inherent in prior art gate opening and closing apparatus when there was a need to push the gate open in the event of a power failure.

The gate opening and closing apparatus of the invention also comprises a solenoid operated locking mechanism 72 and which comprises a solenoid 74 capable of moving a locking pin 76 into and out of an opening 78 in a fixed structure. Thus, when the gate is at the closed position, the solenoid 74 can be energized through the operation of the control unit 26 and which will cause a movement of the locking pin 76 into an opening 78.

The locking mechanism 72, however, in this embodiment of the invention, comprises a DC operated solenoid locking mechanism. Generally, the alternating current solenoids operating locking mechanism have been found to be unreliable. Moreover, if the locking pin should become stuck, the solenoid itself would burn up due to excess current generation in the armature core. In the case of the DC locking mechanism, this problem does not arise. The control unit 26 is more fully illustrated in FIG. 4, as aforesaid and comprises a microprocessor 90 which includes a central processing unit 92 and a latching circuit 94, as well as the memory unit 28. In this case, the memory unit 28 preferably adopts the form of a programable read only memory.

The microprocessor 90 is operated by a master clock circuit 96, a clock pulse generating circuit 98 and an adjustable oscillator 100. The clock pulse generating circuit 98 includes a plurality of inverting amplifiers 102, in the manner as illustrated, along with a capacitor 104 connected across a feedback line 106 between the inverting amplifiers 102. The oscillator 100 also comprises a pair of inverting amplifiers 108 with an adjustable resistor 110 connected in a feedback loop 112 across the amplifiers 108. A switch 114 may be provided for turning the oscillator off and on. The master clock circuit 96 provides the necessary controlled timing for the operation of the entire control unit 26. In addition, the adjustable oscillator 100 controls the rate of movement of the gate during opening and closing.

A signal generator 116 receives an input from the magnetic detector 68 over an input line 118 and which generates an electrical signal and responds to each detection of a rotation of one of the magnetic elements 70. The signal generated by the signal generator 116 is introduced into a counter 120 for determining the number of counts of the rotation of the drive shaft and introduces that number into the central processing unit 92 where it may be stored in the programmable read only memory 28. Thus, the opening and closing movement of the gate can be controlled on all subsequent occasions.

The microprocessor 90 also receives an input from a radio frequency input circuit 122, as illustrated in FIG. 4. This circuit would include a radio frequency sensor 124 connected to a voltage supply 126 forming part of or connected to a resistive network 128. The output of the sensor 124 is introduced through a filtering capacitor 130 and an inverting amplifier 132 into an And gate 134.

The microprocessor 90 also receives a key input from a key input circuit 136 and which also has a key operated mechanism identified by a pair of inputs 138. One of the inputs is connected to a voltage supply, as illustrated. This same input is connected through a coupling resistor 140 and grounded capacitor 142 to an And gate 144. The other of the inputs 138 is also connected through a resistor 146 and a capacitor 148 to the And gate 144. These two inputs are added in the And gate 144 and the output of the key operated circuit 136 is added with the output of the radio frequency input circuit in another And gate 150. The output of this And gate 150 is thereupon introduced into the central processing unit 92.

The control unit 26 of the present invention also comprises a gate obstruction input circuit 152. In this case, a voltage rise, as a result of a back EMF may be generated in the armature of the motor which causes a signal designated by the input 154. This signal is connected to a positive voltage source 156 and is introduced through a coupling resistor 158 into a pair of inputs of an And gate 160. A grounded capacitor 162 and diode resistor arrangement 164 are also connected to the input of the And gate 160.

The control unit 26 also includes a motor controlled locking circuit 165 which has a motor opened input 166 and a motor closed input 168 in the manner as illustrated. These inputs 166 and 168 are connected through resistors of 170 and 172 to an amplifier 174. In addition, diodes 176 are connected across the inputs 166 and 168 in the manner as illustrated. These diodes 176 are each connected to positive voltage sources 180 and are also connected to floating grounds 182 in the manner as illustrated in FIG. 4.

The amplifier 174 is a differential amplifier and generates an output signal when a current is detected on the inputs 166 and 168. In this case, a voltage would be generated by the motor when it is not operating and if someone pushed on the gate to move the same to the opened position from the closed position, this would cause a voltage spike in the field winding of the motor which would be sensed in the circuit as heretofore described.

The output of the differential amplifier 174 is introduced through a resistor 184 into a pair of differential amplifiers 186 and 188. The output of the differential amplifier 188 is introduced into an optical isolator 190 which is comprised of an NPN transistor 192 and a light emitting diode 194. The diode 194 will cause the actuation of the transistor 192 which is sensitive to the light from the diode 194. The collector of the transistor 192 is connected to a positive voltage source and the emitter is connected to an analog-to-digital converter 196, in the manner as illustrated in FIG. 4. In this way, the analog signal which is representative of the motor spike, as heretofore described, will be converted to a digital equivalent signal.

A current sensing transformer 202 is provided for detecting this current rise signal in the field winding of the motor and comprises a primary winding 204 and a secondary winding 206, the later of which has a grounded center tap. Connected to each of the terminals of the secondary winding 206 are a pair of diodes 208. A voltage dividing network 210 is also connected to the output of one of the diodes 208 and is, in turn, connected to the analog-to-digital converter 196. The output of the analog-to-digital converter is thereupon introduced into the central processing unit 92.

In accordance with the above identified construction, it can be observed that upon the sensing of a current spike in the field winding of the motor, a digital signal will be sent to the central processing unit 92 which will, in turn, cause the generation of a signal to initiate a locking action. As heretofore described, the locking action may be that which generates a signal to cause the motor to operate in such manner where it moves the gate to the closed position. In other words, the motor will force the gate to the closed position against the action of someone attempting to move the gate to the opened position. The other type of locking action which may exist is that of initiating a locking action signal to the solenoid 74 causing the pin 76 to move into the opening 78.

The inputs 166 and 168 are essentially motor opened and motor closed position inputs which, in effect, provide a voltage generated by the motor when it is not running. In this way, it is possible to determine the existence of the voltage spike which is generated in the field winding of the motor.

The central processing unit 92 has a third motor operating output 220 which is introduced into a driver circuit 222, having a connection to a positive voltage source 224. The driver circuit 222 is also connected to a triac circuit 226 having a triac 228 connected across a pair of outputs from the driver circuit 222 and a capacitor 230 connected in the manner as illustrated. In addition, the central processing unit 92 is provided with a motor closed circuit output 231 which is also connected to driver circuit 232 similar to the driver circuit 222. The output of the driver circuit 222 is connected to a triac 234, similar to the previously described triac 228. Finally, the central processing unit 92 has another output 238, which is a control solenoid lock output, and which is connected to driver circuits, 240. Again, the driver circuits, 240 and 232 each have connections to a positive voltage source, as shown. The driver circuit 240 is also connected to a conventional triac 242 which is similar to the triac circuit 226 and is further connected to a positive voltage source 244.

The driver circuit 240 also receives a magnetic lock input 246 from a magnetic lock input circuit 248, in the manner as illustrated. Thus, the invention can be operable with the solenoid lock or another form of magnetic lock, or both, as desired.

In accordance with the above identified construction, it can be observed that there has been provided a very unique gate opening and closing apparatus and method. The gate remains unlocked at the closed position and will only lock when a force is applied to the gate. As heretofore described, several different types of locking actions can take place. Nevertheless, the fact that the gate remains unlocked at the closed position, as described, eliminates many of the previously encountered prior problems of gate opening and gate closing apparatus. In addition to the foregoing, it is possible to push against the gate in the event of a power failure since there is no gear arrangement which would preclude an opening action of the gate. The present invention is therefore highly reliable and also can be constructed at a much lower cost than the previously described prior art units. It can also be observed that there can be a small pulley and a large pulley on the output shaft in order to obtain a desired reduction and hence proper gate opening and gate closing speed.

Thus, there has been illustrated and described a unique and novel gate opening and gate closing apparatus and method which fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the the following claims.

Having thus described our invention, what we desire to claim and secure by letters patent is:

1. A gate opening an closing apparatus for moving a gate between a gate closed position and a gate opened position, said apparatus comprising:

a) motive means to drive the gate between the gate opened position and the gate closed position, b) means connecting said motive means to said gate to cause powered movement of the gate between the gate opened and gate closed positions, and c) control means operatively connected to said motive means to control operation of said motive means and hence to control movement of said gate between the gate opened and gate closed positions, said control means causing said gate to move to the closed position and remain at the gate closed position in an unlocked condition, means permitting the gate to remain unlocked after the gate reaches the closed position when no force tends to open the gate but causing a locking action of the gate while at the closed position when an unauthorized force is applied to the gate to move the gate away from the gate closed position.

2. The gate opening and gate closing apparatus of claim 1 further characterized that the unauthorized force is manually applied force.

3. The gate opening and gate closing apparatus of claim 1 further characterized in that a locking mechanism is provided to cause a locking action at the closed position, and that electrical current is provided to said locking mechanism to initiate a locking action and thereby effectively lock the gate in the gate closed position when a force other than from the motive means is applied to the gate to move the gate away from the closed position.

4. The gate opening and gate closing apparatus of claim 1 further characterized in that said locking mechanism comprises a positive solenoid operated locking mechanism and said control means enables generation of a signal to the solenoid of the locking mechanism to positively lock the gate when an unauthorized force is applied to the gate tending to move the gate away from the gate closed position.

5. The gate opening and gate closing apparatus of claim 1 further characterized in that said control means and motive means operate in conjunction with one another to detect an obstruction in the path of movement of the gate and automatically reverses the direction of movement of the gate upon encountering an obstruction.

6. A method for moving a gate between a gate closed position covering an access opening and a gate opened position, said method comprising:

a) driving the gate with a motive means between the gate opened position and the closed position, causing the gate to move to the closed position and remain at the gate closed position in an unlocked condition when it is desired to close the access opening, and c) permitting the gate to remain unlocked after the gate reaches the closed position when no force tends to open the gate but causing a locking action of the gate while at the closed position when an unauthorized action attempts to move the gate away from the gate closed position.

7. The method of claim 6 further characterized in that said method comprises manually opening the gate when the gate is unlocked and no electrical power is available to the motive means.

8. The method of claim 7 further characterized in that said method comprises generating a positive locking action with a locking mechanism at the gate when a manual force is applied to the gate to move the gate away from the closed position.

9. A gate opening and closing apparatus for moving a gate between a gate closed position and a gate opened position, said apparatus comprising:

a) driving means for moving the gate between the gate opened position and the gate closed position, and b) control mans operatively connected to said driving means permitting the gate to remain unlocked after the gate reaches the closed position when no force tends to open the gate but causing a locking action of the gate while at the closed position when an unauthorized force is applied to the gate to move the gate away from the gate closed position.

10. The gate opening and gate closing apparatus of claim 9 further characterized in that the unauthorized force is a manual force.

11. The gate opening and gate closing apparatus of claim 9 further characterized in that a locking mechanism is provided to cause a locking action at he closed position, and that electrical current is provided to said locking mechanism to initiate a locking action and thereby effectively lock the gate in the gate closed position when an unauthorized force is applied to the gate to move the gate away from the gate closed position.

12. The gate opening and gate closing apparatus of claim 11 further characterized in that said locking mechanism comprises a positive solenoid operated locking mechanism and said control means enables generation of a signal to the solenoid of the locking mechanism to positively lock the gate when an unauthorized force is applied to the gate tending to move the gate away from the closed position.

13. A method for controlling a locking action for a gate which is moveable between agate closed position covering an access opening and a gate opened position, said method comprising:

a) driving the gate between the gate opened position and the closed position, and b) permitting the gate to remain unlocked after the gate reaches the closed position when no force tends to open the gate but causing a locking action of the gate while at the closed position when an unauthorized force is applied to the gate to move the gate away from the gate closed position.

14. The method of claim 13 further characterized in that said method comprises manually opening the gate when the gate is unlocked an no electrical power is available to the motive means.

15. The method of claim 13 further characterized in that said method comprises generating a positive locking action with a locking mechanism at the gate when a manual force is applied to the gate to move the gate away from the closed position.

16. A gate locking apparatus for controlling the locking action of a gate which is moveable between a gate closed position and a gate opened position, said apparatus comprising means which permits the gate to remain unlocked after the gate reaches the closed position when no force tends to open the gate, said last named means being operable to cause a locking action of the gate while at the closed position when an unauthorized when force is applied to the gate to move the gate away from the gate closed position.

17. The gate locking apparatus of claim 16 further characterized in that a locking means is provided to initiate an electric current to initiate a locking action and thereby effectively lock the gate in the gate closed position when an unauthorized force is applied to the gate to move the gate away from the closed position.

18. The gate opening and gate closing apparatus of claim 17 further characterized in that said locking means comprises a positive solenoid operated locking mechanism and said generation of the current is a signal to the solenoid of the locking means to positively lock the gate when an unauthorized force is applied to the gate tending to move the gate away from the gate closed position.

19. A gate opening and closing apparatus for moving a gate between a gate closed position and a gate opened position, said apparatus comprising:

a) motive means to drive the gate between the gate opened position and the gate closed position, b) means connecting said motive means to said gate to cause powered movement of the gate between the gate opened and gate closed position, c) locking means associated with the gate to cause a locking action and thereby lock the gate at the closed position, said locking means being operable by energization of an electrical member to cause a locking action, and d) control means causing said gate to move to the closed position and remain at the gate closed position in an unlocked condition without causing energization of said electrical member, said control means causing energization of the electrical member when an unauthorized force is applied to the gate to move the gate away from the gate closed position.

20. The gate opening and gate closing apparatus of claim 19 further characterized in that an electrical current is provided to said locking mechanism to initiate a locking action and thereby effectively lock the gate in the gate closed position when a force other than from the motive means is applied to the gate to move the gate away from the closed position.

* * * * *